US006062307A

United States Patent [19]

Hamid et al.

[11] Patent Number: 6,062,307

[45] Date of Patent: May 16, 2000

[54] SCREEN ASSEMBLIES AND METHODS OF SECURING SCREENS

[75] Inventors: Syed Hamid; Joseph L. Pearce; Gregory Byron Chitwood, all of Dallas; Patrick W. Rice, Plano, all of Tex.

[73] Assignee: Halliburton Energy Services, Inc., Dallas, Tex.

[21] Appl. No.: 08/957,164

[22] Filed: Oct. 24, 1997

[51] Int. Cl.[7] ..... E21B 43/04

[52] U.S. Cl. ..... 166/51; 166/55; 166/233

[58] Field of Search ..... 166/278, 50, 51, 166/55, 233, 237

[56] References Cited

U.S. PATENT DOCUMENTS

| | | | |
|---|---|---|---|
| 4,402,830 | 9/1983 | Pall | 210/457 |
| 4,613,369 | 9/1986 | Koehler | 75/246 |
| 5,295,538 | 3/1994 | Restarick | 166/147 X |
| 5,318,119 | 6/1994 | Lowry et al. | 166/233 X |
| 5,327,974 | 7/1994 | Donovan et al. | 166/311 |
| 5,377,750 | 1/1995 | Arterbury et al. | 166/228 X |

OTHER PUBLICATIONS

Offshore Magazine/Rick Von Flatern, Sand Control Complexity Grows with Water Depth, Jul. 1997, 3 pages.

*Primary Examiner*—Roger Schoeppel

*Attorney, Agent, or Firm*—William M. Imwalle; Jonathan M. Pierce

[57] ABSTRACT

A screen or filter assembly is described as well as improved methods of affixing such assemblies to a portion of an oil or gas production assembly. A nonrigid attachment for reversibly securing a tubular screen to a portion of a production string is disclosed which significantly reduces the risk of the connection between the screen and the production nipple from being broken. In a preferred embodiment, an end cap is described having a projecting lip which secures one end of the screen body to a perforated sub. A removable threaded retaining sleeve is used to secure the other end of the screen body to the perforated sub. A compression ring is associated with the threaded connector to assist in securing the screen body end. A pair of deformable rings are placed adjacent each of the screen body ends to absorb service loads. The screen assembly may be subjected to operational tensile and compressive stresses and thermal expansions and contractions without significant risk of connection failure.

17 Claims, 4 Drawing Sheets

16
36
52
58
56
64
62
66
48
60
38
38
38

SCREEN ASSEMBLIES AND METHODS OF SECURING SCREENS

TECHNICAL FIELD OF THE INVENTION

The present invention relates generally to screens and filters used in oil and gas well applications.

BACKGROUND OF THE INVENTION

Screens and filters of various types are used in oil and gas well applications for control of particulate solids. Some of these are downhole screens designed to surround perforated portions of production tubing or a perforated production sub, so that produced fluids and gases may enter the production tubing while leaving undesirable solids, such as formation sand, in the annulus. During production operations, or operations such as fracturing or acidizing, production tubing is subjected to thermal changes, changes in pressures, and mechanical loads that cause the metallic tubing to expand or contract. Also, directional wells contain bends or elbows. When production tubing is run into a wellbore of this type, the tubing must conform to the bends or elbows. Bending of the production tubing induces tensile and compressive stresses within connection welds that affix the screen jacket to the tubing, sometimes causing the welds to weaken and break. Broken weld connections allow the screen jacket to slide along the tubing, uncovering the perforated portions of the production tubing.

SUMMARY OF THE INVENTION

The present invention is directed to a screen or filter assembly for use in oil and gas wells as well as improved methods of affixing such filters to a portion of a production assembly. The invention describes a nonrigid means of reversibly securing a tubular screen jacket to a production nipple portion of a production string thereby significantly reducing the risk of breaking the connection between the screen jacket and the production tubing. In a preferred embodiment, the invention features an end cap with a projecting lip that secures one end of the screen jacket to a perforated sub and a removable threaded connector which is used to secure the other end of the screen jacket to the perforated sub. A metallic compression ring is used with the threaded connector to assist in securing the screen jacket end. A pair of deformable elastomeric rings are placed adjacent each of the screen jacket ends to absorb service loads, thereby enabling the inventive screen assembly to withstand operational stresses without significant risk of connection failure.

BRIEF DESCRIPTION OF THE DRAWINGS

For an introduction to the detailed description of the preferred embodiments of the invention, reference will now be made to the accompanying drawings, wherein.

DETAILED DESCRIPTION OF THE PREFERRED EMBODIMENT

Figure 1:
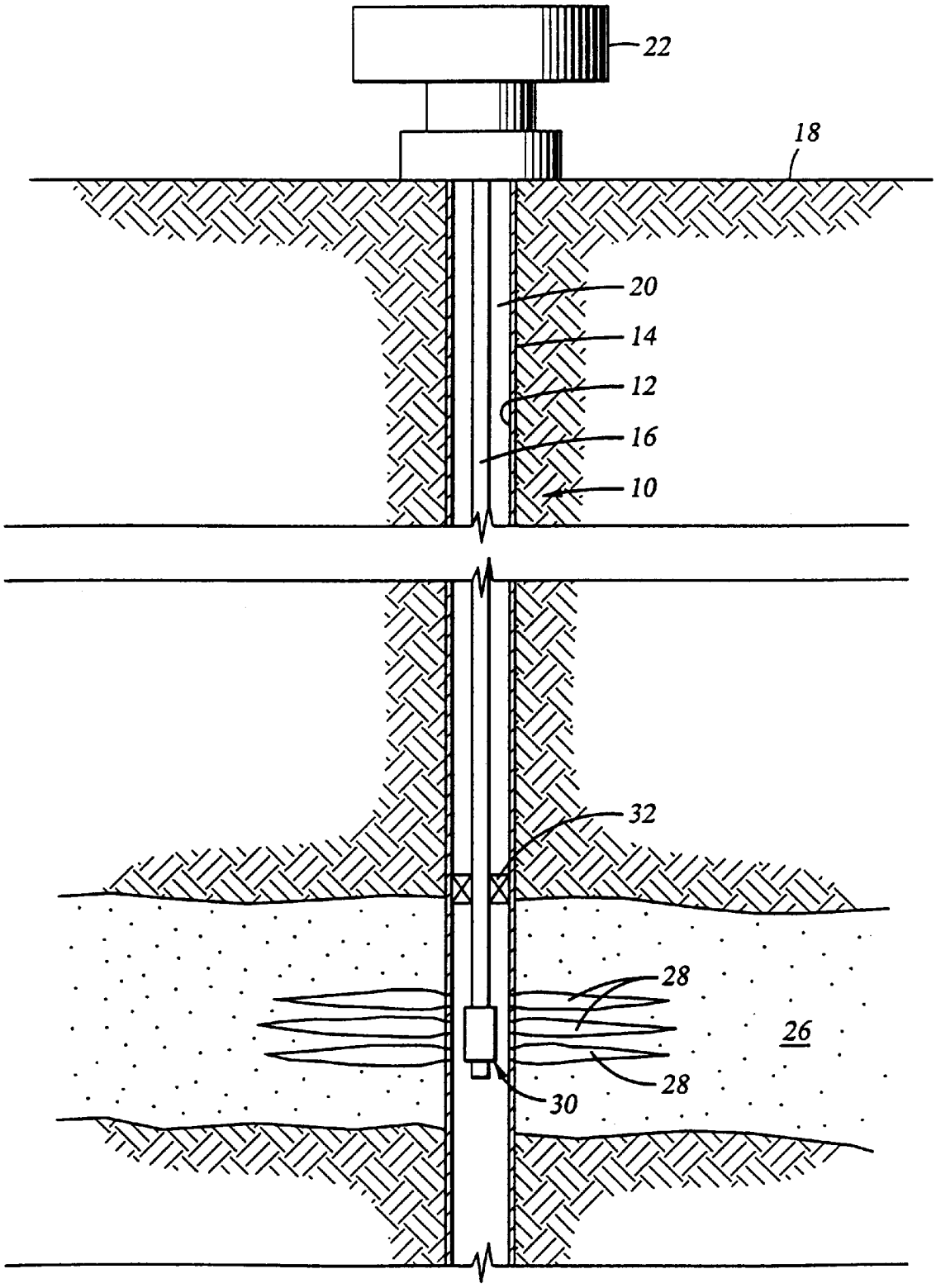
FIG. 1 is a cross-sectional overall view of an exemplary production assembly.

Referring now to FIG. 1, an exemplary hydrocarbon production arrangement 10 is shown with a subterranean wellbore 12 having an outer casing 14. According to normal convention, a tubular production string 16 extends from the surface 18 within the casing 14, defining an annulus 20 between the production string 16 and casing 14. The production string 16 is operably connected to a production wellhead 22 at the surface 18 in order that production fluid may be drawn from the production string 16 by pumps or other well known methods which will not be described here.

The wellbore 12 passes through a potential producing zone 26 wherein the casing 14 has been perforated previously by a perforating gun or other suitable perforating device. These perforations are shown schematically at 28 to extend entirely through the casing 14 and into the potential producing zone 26. A well screen assembly 30 is incorporated within the production string 16 and is located within the wellbore 12 proximate the potential producing zone 26 to receive petrochemical fluids from the zone and transmit them into the interior of the production string 16. As a consequence, production fluid is transmitted upward through the production string 16 which extends to the production wellhead 22 above. A packer 32 is placed within the annulus 20 above the well screen assembly 30. The present invention is suitable for application with either vertical or deviated wells producing from single or multiple zones requiring multiple well screens. Additionally, neither the location of the production arrangement (subterranean vs. subsea) nor the nature of the produced fluids or gases is a significant factor in using the present invention.

Figure 2:
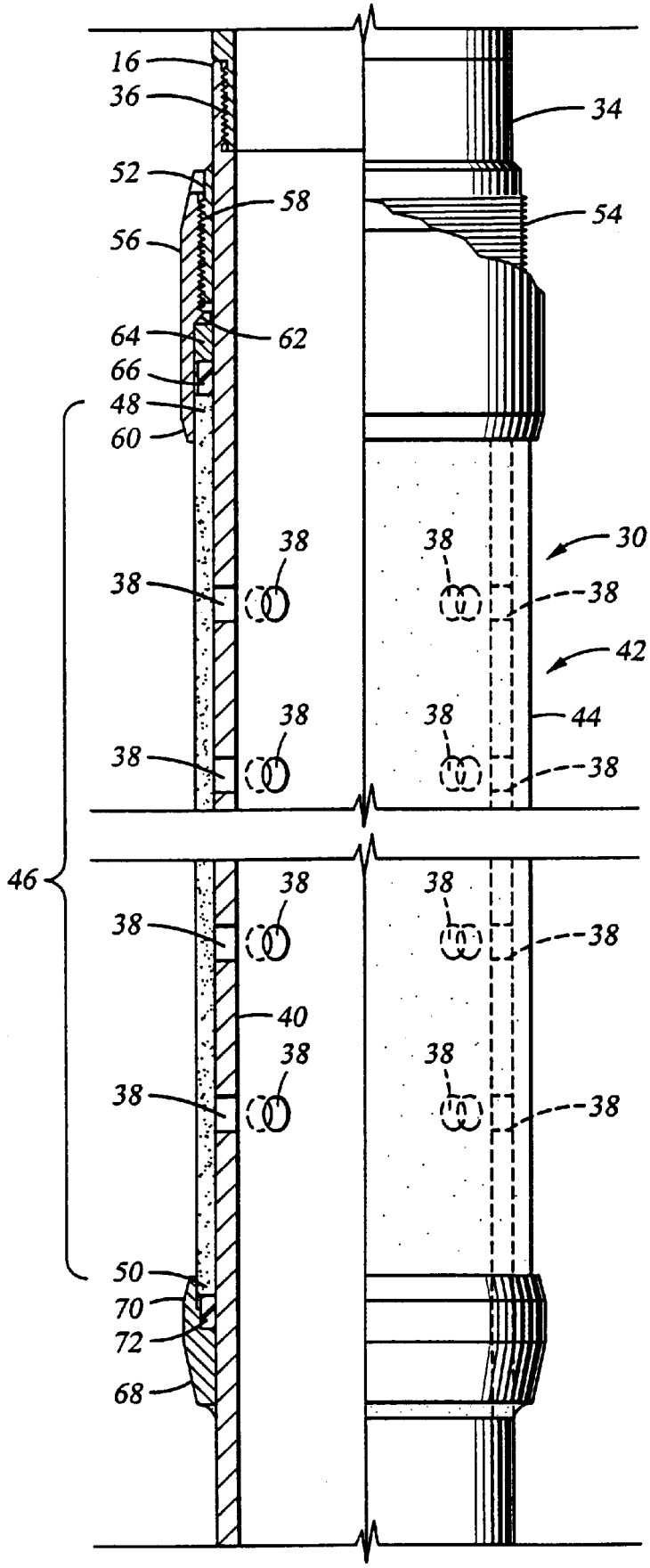
FIG. 2 is a cross-sectional view of a screen assembly affixed to a portion of production tubing in accordance with the present invention.

Referring now to FIG. 2, the well screen assembly 30 is depicted in greater detail. The well screen assembly 30 includes a tubular sub 34 which is affixed at its upper end by a threaded connection 36 to the tubing string 16. A number of perforations 38 are disposed through the sub 34 to permit fluid communication therethrough and into the fluid bore 40 formed by the tubular sub 34.

A tubular screen assembly 42 radially surrounds the sub 34 to cover the perforations 38. The screen assembly 42 includes porous screen body 44 which is made of a sintered, powdered metal which allows liquids and gases to pass through, but substantially prevents solids larger than a certain size from passing. The screen body 44 has a working length 46 which is used to cover the perforations 38 and a pair of axial ends 48, 50. One example of a suitable screen body of this type is the SINTERPAK® screen jacket available from the Halliburton Well Screens division of Halliburton Company located at 1815 Shearn, Houston, Tex. 77007. However, the invention is capable of being used with other model screen jackets made by other manufacturers as well.

The screen assembly 42 also includes an annular band 52 having radially outer threads 54. The band 52 is fixedly disposed upon the sub 34 using techniques such as structural welding. Threading or other suitable methods may also be used. An annular retaining sleeve 56 has inner threads 58 which are complimentary to the outer threads 54 of the annular band 52 so that the retaining sleeve 56 may be threadedly engaged onto or removed from the band 52. The annular sleeve 56 also includes an unthreaded lip 60 which projects downwardly. A downward and radially inward projecting shoulder 62 is presented on the inner surface of the sleeve 56. Disposed radially between the lip 60 and the sub 34 is a metallic compression ring 64 which engages the shoulder 62 when the sleeve 56 is moved to its lower position. An elastomeric, thermoplastic or other deformable type of sealing ring 66 is also located radially inside of the lip 60 so as to be positioned between the compression ring 64 and the end 48 of the screen body.

The screen assembly 42 also includes an annular end cap 68 which is rigidly affixed to the sub 34 and presents a projecting lip 70. A second elastomeric, thermoplastic or other deformable type of sealing ring 72 is disposed radially inside of the lip 70.

The screen body 44 is secured to the sub 34 before the sub 34 is affixed to the production string 16 and run into the well 10. With the annular sleeve 56 having been removed from the sub 34, the screen body 44 is slidingly disposed onto the outer radial surface of the sub 34 until the end 50 of the screen body 44 becomes disposed beneath the lip 70 of the end cap 68 and abuts the elastomeric ring 72. The annular sleeve 56 is then inserted onto the upper end of the sub 34. The threaded engagement between the annular band 52 and the sleeve 56 pernmits the annular sleeve 56 to be rotated and moved to a secured position, depicted in FIG. 2. When the annular sleeve 56 is moved into its secured position, the lip 60 will cover the end 48 of the screen body 44 and the shoulder 62 will engage the compression ring 64 to urge it and the deformable ring 66 against the end 48 of the screen body 44. The sub 34 can then be affixed to the production tubing string 16 by the threaded connection 36.

Removal of the screen body 44 is effected by essentially reversing the above procedure. The sub 34 is separated from the production string 16 and the annular sleeve 56 is removed. The screen body can then be slid off of the sub 34. As a result, the screen body 44 can be readily removed and replaced when desired, such as when the screen body 44 becomes clogged with debris or worn out from extended use, without having to cut or break welds.

When the screen body 44 is secured to the sub 34 in this manner, the connections for each of its ends 48, 50 can be loaded in service through compression, tension, torsion or combinations of these forces, without resulting in failure, as might occur with a rigid connection to the sub 34. Each of the rings 66, 72 can be deformed, allowing the ends 48, 50 to be urged against the compression ring 64 and end cap 68 without resulting in failure of the connection. The ends of this screen body 44 can thus move in a slidable fashion with respect to the sub 34. Also, the ends 48, 50 will remain retained beneath the projecting lips 60, 70 if the ends 48, 50 are drawn away from the deformable rings 66, 72.

Figure 3:
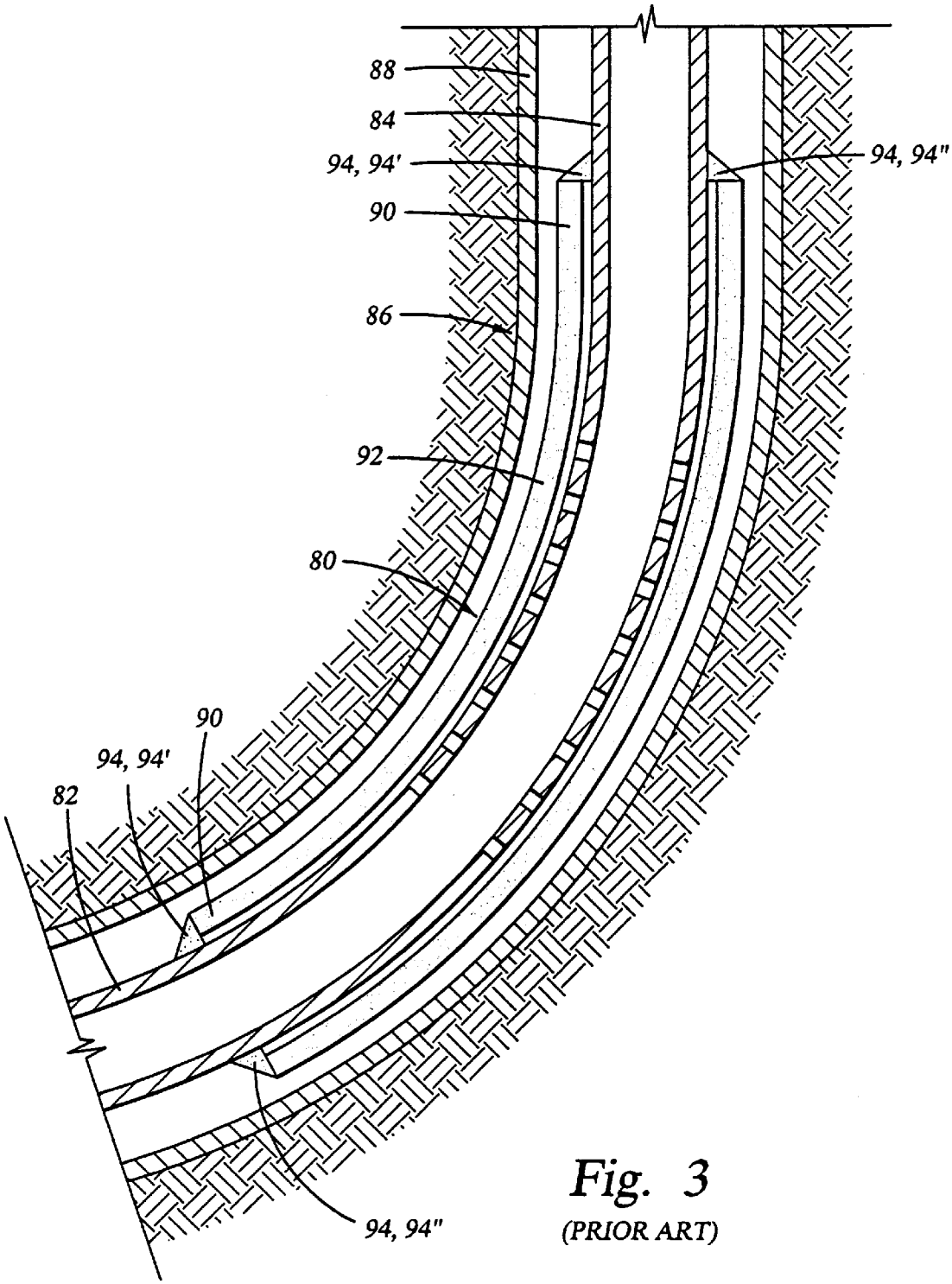
Fig. 3 (PRIOR ART)
FIG. 3 is a cross-sectional view of an exemplary prior art screen assembly disposed within a bent section of well casing.

The problems associated with use of prior art screening systems in bent sections of casing are better understood with reference to FIG. 3 which depicts a prior art screen assembly 80 which is incorporated onto a perforated sub 82 in a production string 84. The sub 82 is being disposed through a bent section 86 of wellbore casing 88. It is noted that the ends 90 of the screen body 92 are welded at 94 to the sub 82. On the inner radial portion of the bend 86, the welds are loaded in compression (shown as 94') while at the outer radial portion of the bend 86, the welds are loaded in tension (shown as 94"). Because the weld connections 94 are inherently rigid connections, they transfer loads to the weaker screen body 92 which may fail through separation from the sub 82.

It is pointed out that prior art screening assemblies such as assembly 80 are also prone to failure even where the casing is straight if the sub and screening assembly are placed under mechanical and thermal stresses of the type normally associated with production operations. For example, the screen body, being made of metal, will tend to expand and contract both axially and radially with temperature, as will the perforated sub. When this expansion and contraction occurs in a differential manner among interconnected components, further stress will be placed upon the welds.

Figure 4:
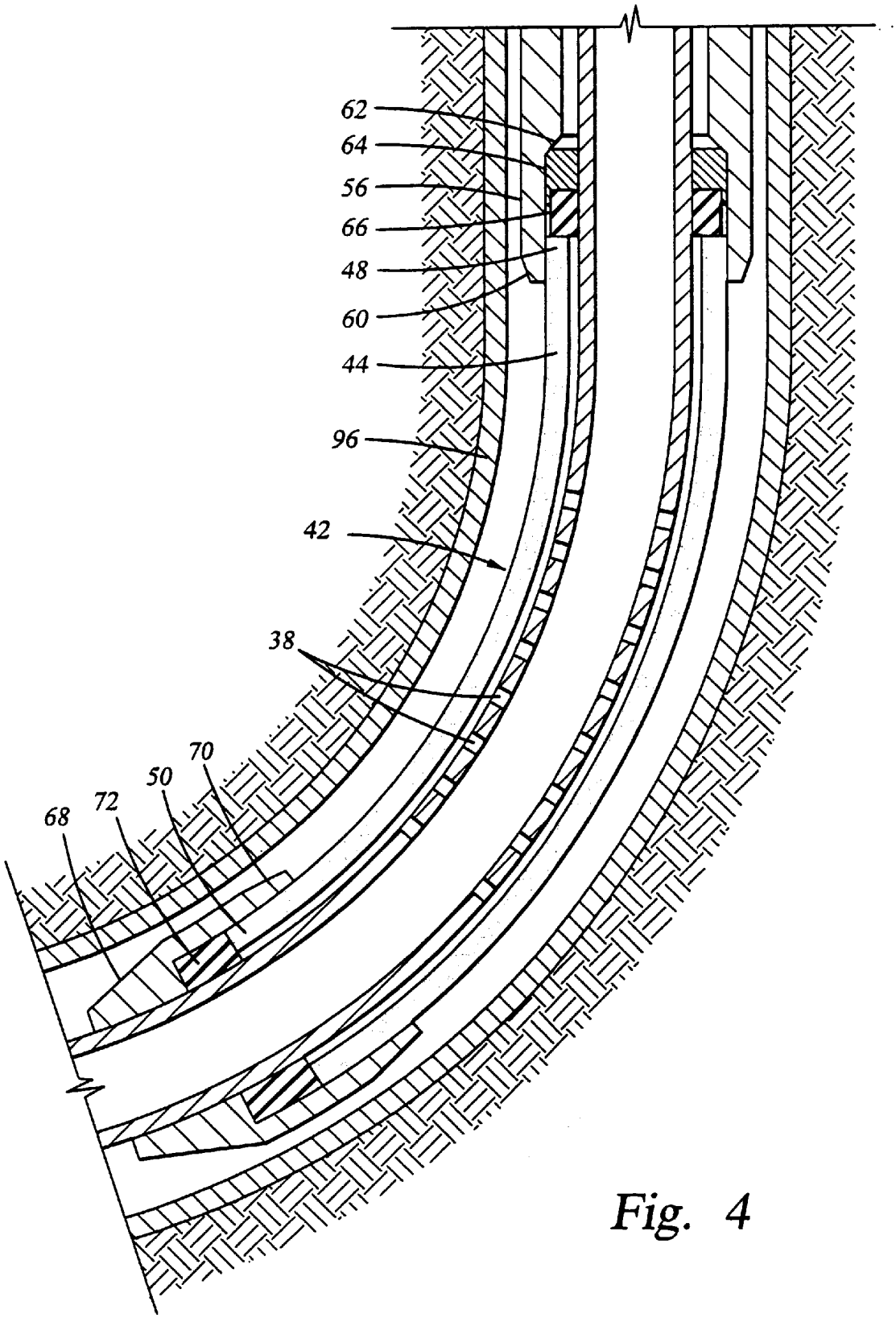
FIG. 4 is a cross-sectional view of an exemplary screen assembly constructed in accordance with the present invention, also disposed within a bent section of tubing.

FIG. 4 illustrates the improved performance associated with the present invention. FIG. 4 depicts the screening assembly 42, heretofore described, wherein the screen body 44 is secured to the sub 34 in the manner previously described. When the well screen assembly 30 is disposed within a bent section of wellbore casing 96, the securing means for ends 48, 50 deform but do not fail. As a result, the connections at the ends 90 of the screen body 92 are capable of absorbing the service loads placed upon them in compression and in tension.

It should be understood that the present invention has been described and disclosed in terms of a preferred embodiment. However, the invention is not so limited. For example, the invention may be used in water-well applications as well as oil and gas wells. Those skilled in the art will understand that numerous other modifications and variations in the details of the invention can be made without departing from the scope of the invention.

What is claimed is:

1. A screen assembly for production tubing, the screen assembly comprising:

a) a screen having a generally tubular body and first and second axial ends and adapted to be slidably disposed upon a section of production tubing;

b) a first connector to secure the first axial end to a section of production tubing, the first connector being securely affixed to a section of production tubing and securing the first axial end against the section of production tubing; and c) a second connector for securing the second axial end to a section of production tubing, the second connector being selectively removable from the second axial end.

2. The screen assembly of claim 1 wherein the first connector comprises an end cap.

3. The screen assembly of claim 1 wherein the second connector comprises a threaded sleeve to retain the second axial end in a secured relation against a section of production tubing.

4. A screen assembly for production tubing comprising:

a generally tubular screen body having at least one axial end; and a connection for releasably securing the axial end to a portion of the production tubing.

5. A screen assembly for production tubing comprising:

a generally tubular screen body having at least one axial end; and a connection for reversibly securing the axial end to a portion of the production tubing, the connection comprising a threaded connector.

6. The screen assembly of claim 5 wherein the threaded connector further comprises a lip to retain the axial end in securable relation to production tubing.

7. The screen assembly of claim 5 further comprising a substantially deformable ring disposed between the threaded connector and the axial end of the screen body.

8. The screen assembly of claim 7 further comprising an annular compression ring to transmit load between the threaded connector and the deformable ring.

9. A method of removably securing a screen to a perforated tubular member, comprising the steps of:

a) disposing a substantially tubular screen body onto the radial outer surface of the perforated tubular member;

b) securing a first axial end of the screen body upon the tubular member; and c) reversibly securing a second axial end of the screen body upon the perforated tubular member.

10. The method of claim 9 wherein the step of securing a first axial end comprises disposing the first axial end of the tubular screen body beneath a securing lip to secure the first end against the tubular member.

11. The method of claim 9 wherein the step of reversibly securing a second axial end comprises disposing a retaining sleeve over a second axial end of the tubular screen body to secure the second end against the perforated tubular member.

12. The method of claim 11 wherein the step of disposing a retaining sleeve further comprises threadedly disposing the retaining sleeve onto the perforated tubular member.

13. A screen assembly for production tubing, the screen assembly comprising:

a generally tubular screen body to surround a portion of production tubing;

a first connector for reversibly securing a portion of the screen body to the portion of production tubing, the first connector including a substantially deformable seal to absorb service loads applied to the connection.

14. The screen assembly of claim 13 wherein the substantially deformable seal is comprised of an elastomeric material.

15. The screen assembly of claim 13 wherein the first connector further comprises an annular lip to retain the axial end in securable relation to the portion of the production assembly.

16. The screen assembly of claim 15 wherein the lip is formed by a threaded sleeve which is reversibly engageable with the portion of the production assembly.

17. A screen assembly for production tubing, the screen assembly comprising:

a) a screen having a generally tubular body and adapted to be slidably disposed upon a section of production tubing the screen body having a first axial end;

b) a first connector to releasably secure the first axial end to a section of production tubing, the first connector comprising a substantially deformable seal member which permits the first axial end to slidably move with respect to the section of production tubing.

* * * * *